US007503176B2

(12) United States Patent
Yatsuzuka et al.

(10) Patent No.: US 7,503,176 B2
(45) Date of Patent: Mar. 17, 2009

(54) LIQUID PUMP AND RANKINE CYCLE APPARATUS

(75) Inventors: Shinichi Yatsuzuka, Chiryu (JP); Shuzo Oda, Kariya (JP); Katsuya Komaki, Kariya (JP); Yasumasa Hagiwara, Kariya (JP)

(73) Assignee: Denso Corporation, Kariya (JP)

( * ) Notice: Subject to any disclaimer, the term of this patent is extended or adjusted under 35 U.S.C. 154(b) by 828 days.

(21) Appl. No.: 11/070,031

(22) Filed: Mar. 1, 2005

(65) Prior Publication Data

US 2005/0193735 A1 Sep. 8, 2005

(30) Foreign Application Priority Data

Mar. 5, 2004 (JP) ..... 2004-062502

(51) Int. Cl.
*F01K 1/00* (2006.01)

(52) U.S. Cl. ..... 60/659; 60/670

(58) Field of Classification Search ..... 60/643, 60/645, 660, 659, 670
See application file for complete search history.

(56) References Cited

U.S. PATENT DOCUMENTS 2,278,085 A * 3/1942 Ostermann ..... 60/670
3,721,509 A * 3/1973 Kitrilakis ..... 417/339
4,249,378 A * 2/1981 Benson ..... 60/525
5,442,914 A * 8/1995 Otsuka ..... 60/527
5,876,259 A * 3/1999 Nakamura ..... 440/56
6,422,836 B1 * 7/2002 Krueger et al. ..... 417/418
2004/0060294 A1 4/2004 Yatsuzuka et al.

FOREIGN PATENT DOCUMENTS

EP 1 405 987 4/2004
JP 2003-161101 6/2003

* cited by examiner

*Primary Examiner*—Hoang M Nguyen
(74) *Attorney, Agent, or Firm*—Harness, Dickey & Pierce, PLC

(57) ABSTRACT

A liquid pump for circulating working fluid (water) in a Rankine cycle comprises a U-shaped fluid vessel having a bending pipe portion and a pair of straight pipe portions, wherein a heating device and a cooling device are provided at one of the straight pipe portions for heating and cooling the water in the fluid vessel. The liquid pump further has a discharge pipe portion and an inlet pipe portion, and check valves are respectively provided in the discharge and inlet pipe portions. The water is vaporized by a heating operation of the heating device to increase pressure of the working fluid in the pump, so that the working fluid is discharged. The vaporized working fluid is then cooled down by the cooling device to decrease the pressure of the working fluid in the pump, so that the working fluid is sucked into the pump.

13 Claims, 3 Drawing Sheets

FIG. 1
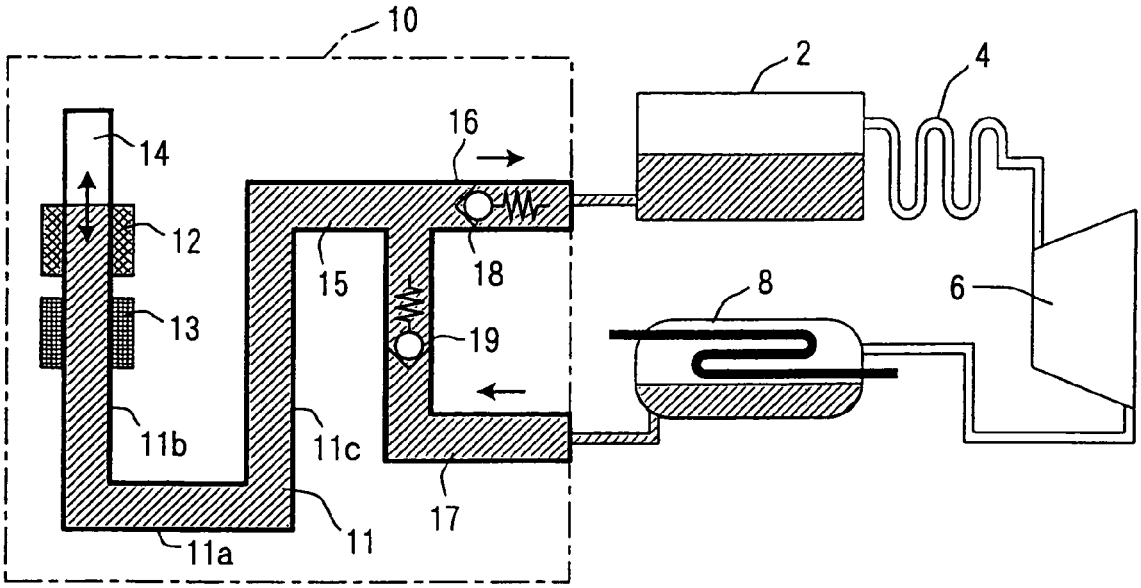
FIG. 2A
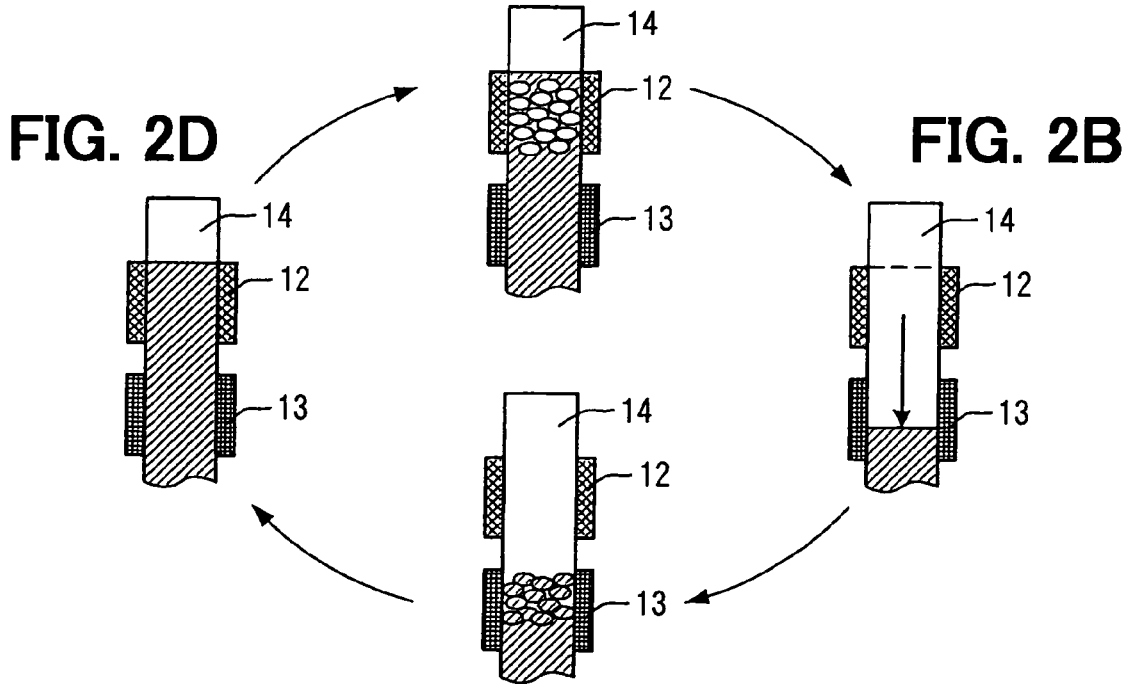
FIG. 2C

LIQUID PUMP AND RANKINE CYCLE APPARATUS

CROSS REFERENCE TO RELATED APPLICATION

This application is based on Japanese Patent Application No. 2004-062502 filed on Mar. 5, 2004, the disclosure of which is incorporated herein by reference.

FIELD OF THE INVENTION

The present invention relates to a liquid pump for circulating working fluid in Rankine cycle, and also to a Rankine cycle apparatus using the liquid pump.

BACKGROUND OF THE INVENTION

In a conventional Rankine cycle apparatus for generating kinetic energy by using working fluid, such as water, the working fluid is heated by a boiler or a heating device to produce high pressure vapor, and the high pressure vapor is used to drive a turbine or pistons for generating the kinetic energy. The vapor used for such driving operation is collected by a water condensing device, wherein the vapor is liquidized which is again supplied to the boiler by the liquid pump. As above the working fluid is circulated in the Rankine cycle apparatus. This kind of conventional apparatus is disclosed, for example, in Japanese Patent Publications Nos. 2003-97222 and 2003-161101.

In the above conventional Rankine cycle apparatus, an electric pump of an electrically driven type is generally used as the liquid pump for circulating the working fluid. Therefore, in the conventional Rankine cycle apparatus, it has been necessary to provide a driving circuit, an electric power supply circuit and so on for driving the electric pump. As a result, the conventional apparatus has a complicated structure and high in cost.

SUMMARY OF THE INVENTION

It is, therefore, an object of the present invention, in view of the above mentioned problems, to provide a liquid pump which can circulate working fluid in a Rankine cycle apparatus without using electric power and can be realized with low cost, and it is a further object of the present invention to provide a Rankine cycle using the above liquid pump.

According to a feature of the present invention, a liquid pump comprises a fluid vessel filled with working fluid (water), a heating device for heating and vaporizing the working fluid in the fluid vessel, and a cooling device for cooling and liquidizing vaporized steam of the working fluid.

When the steam of the vaporized working fluid is produced in the fluid vessel by the heating device, and the working fluid moves in the fluid vessel due to expansion pressure of the steam, a discharge check valve of the liquid pump is opened to discharge the working fluid from the fluid vessel to an outside.

When the steam in the fluid vessel is cooled down and liquidized by the cooling device, the pressure in the fluid vessel is decrease, the working fluid moves in a reversed direction and a negative pressure is produced in the fluid vessel, so that an inlet check valve of the liquid pump is opened to suck the working fluid into the fluid vessel from the outside.

Accordingly, since the liquid pump of the present invention can discharge and suck the working fluid by simply heating and cooling the working fluid in the fluid vessel, it is not necessary to provide an electric power supply circuit and an electric driver circuit for supplying electric energy to an electrical pump, which is generally used in a conventional Rankine cycle apparatus. As a result, when the liquid pump of the present invention is used for circulating the working fluid in the Rankine cycle apparatus, the cost for the Rankine cycle apparatus can be reduced.

It is necessary to heat and cool the working fluid in the fluid vessel in order to operate the liquid pump of the present invention. However, in the case that the liquid pump of the present invention is used for the Rankine cycle apparatus, the heat for super-heating the working fluid as well as cooling water for cooling the working fluid for operating the Rankine cycle can be used for heating and cooling the working fluid for operating the liquid pump. Accordingly, a running cost for operating the liquid pump can be remarkably reduced.

According to another feature of the present invention, the fluid vessel comprises a U-shaped pipe portion having a bending pipe portion arranged at a vertically lowermost position and a pair of vertically extending straight pipe portions extending from the bending pipe portion. And the heating device as well as the cooling device is provided at one of the straight pipe portions, an upper end of which is closed, in such a manner that the heating device is arranged at a vertically higher than the cooling device. And an outlet (discharge) pipe portion and an inlet pipe portion are respectively connected to an upper end of the other straight pipe portion. Accordingly, the working fluid in the straight pipe portion is expanded and contracted by the heating and cooling operation of the heating and cooling devices, to generate a self-vibrating fluid flow in the liquid pump. In this arrangement, the time for heat exchange between the working fluid and the heating and cooling devices can be made longer, to thereby improve an operational efficiency of the liquid pump.

Furthermore, the liquid pump can be made in a small size, when compared with such a liquid pump in which a fluid vessel is formed from a straight pipe portion instead of the U-shaped pipe portion.

According to a further feature of the present invention, an inert gas is filled in the upper portion of the straight pipe portion at which the heating and cooling device are provided, to further enhance the pump efficiency.

According to a still further feature of the present invention, the fluid vessel is formed from a circular pipe portion, and the cooling device is arranged at a vertically higher than the heating device. And an outlet (discharge) pipe portion and an inlet pipe portion are respectively connected to an upper end of the circular pipe portion. Accordingly, the working fluid in the circular pipe portion is likewise expanded and contracted by the heating and cooling operation of the heating and cooling devices, to generate a self-vibrating fluid flow in the liquid pump.

According to a still further feature of the present invention, a control valve can be provided at a lower pipe portion of the circular pipe fluid vessel, wherein the control valve periodically opens and closes a fluid passage of the circular pipe portion. Accordingly, the time for heat exchange between the working fluid and the heating and cooling devices can be easily controlled to make it longer, to thereby improve an operational efficiency of the liquid pump.

BRIEF DESCRIPTION OF THE DRAWINGS

The above and other objects, features and advantages of the present invention will become more apparent from the following detailed description made with reference to the accompanying drawings. In the drawings:

FIG. 1 is a schematic view showing a Rankine cycle apparatus according to a first embodiment of the present invention;

FIGS. 2A to 2D are explanatory views for explaining an operation of a water pump (a liquid pump) according to the first embodiment of the present invention;

DETAILED DESCRIPTION OF THE PREFERRED EMBODIMENTS

First Embodiment

Figure 3:
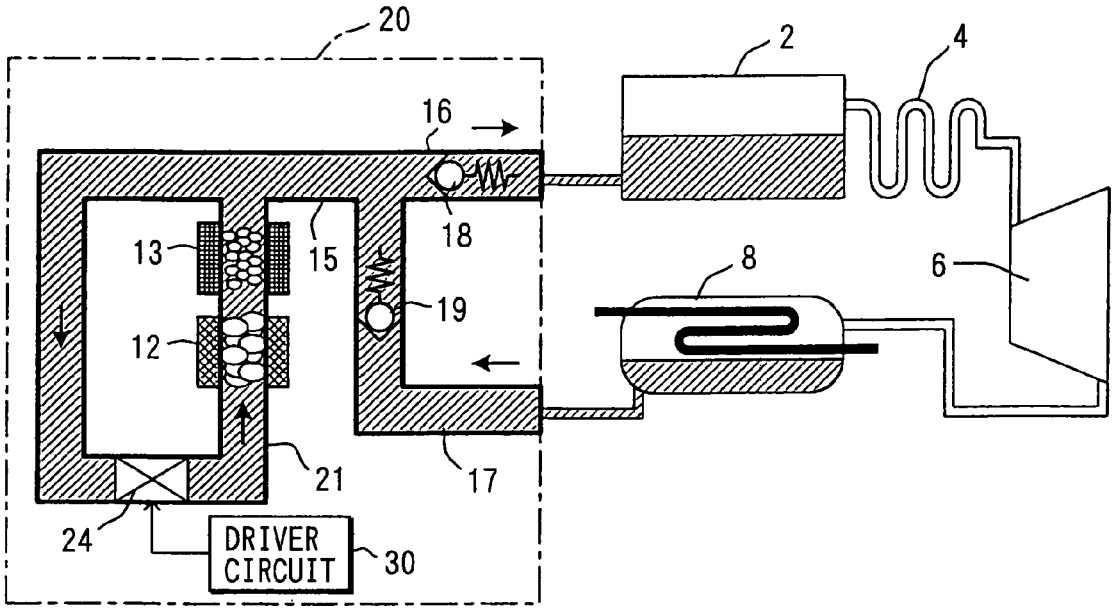
FIG. 3 is a schematic view showing a Rankine cycle apparatus according to a second embodiment of the present invention.

A first embodiment of the present invention will now be explained with reference to the drawings, wherein FIG. 1 is a schematic view showing a Rankine cycle apparatus according to a first embodiment of the present invention.

The Rankine cycle apparatus comprises a boiler 2 for producing a vapor by heating water as working fluid, a super-heating device 4 for producing high pressure steam by super-heating the vaporized working fluid produced at the boiler 2, a turbine 6 to be driven by the high pressure steam produced by the super-heating device 4, a water condensing device 8 for cooling down the steam used at the turbine 6 and liquidizing to the water, and a liquid pump (a water pump) 10 for sucking the working fluid (water) liquidized at the water condensing device 8 and for supplying the water to the boiler 2.

The water pump 10 is not an electrical pump generally used in a conventional Rankine cycle apparatus but a fluid pump, to which the present invention is applied.

The water pump 10 comprises a fluid vessel 11 into which the working fluid (water) for the Rankine cycle apparatus is filled and in which the working fluid can move (or flow), a heating device 12 for heating the working fluid in the fluid vessel 11, and a cooling device 13 for cooling down steam vaporized by heating the working fluid at the heating device 12.

The fluid vessel 11 is made of such material having a high heat insulating performance (such as stainless steel in this embodiment, because water is used as the working fluid), for those portions other than those for the heating device 12 and the cooling device 13, while those portions for the heating device 12 and the cooling device 13 are made of such material having higher thermal conductivity, as cupper or aluminum.

The fluid vessel 11 has a U-shaped pipe portion comprising a bending pipe portion 11*a* and a pair of straight pipe portions 11*b* and 11*c*, which vertically extend from the bending pipe portion 11*a*, wherein the bending pipe portion 11*a* is arranged that it is located at a lower-most position.

The heating device 12 and the cooling device 13 are provided at one (11*b*) of the straight pipe portions 11*b* and 11*c*, in such a manner that the heating device 12 is located at a vertically higher position than the cooling device 13. A top end of the straight pipe portion 11*b* is closed and an inert gas which does not react on the working fluid, such as nitrogen, helium etc. is filled in a top end portion of the straight pipe portion 11*b*.

The fluid vessel 11 further has a horizontally extending pipe portion 15 extending from an upper end of the straight pipe portion 11*c*, and the other end of the horizontal pipe portion 15 is connected to an outlet (discharge) pipe portion 16 for discharging the working fluid from the fluid vessel 11 to the boiler 2, and further connected to an inlet pipe portion 17 for sucking the working fluid from the water condensing device 8.

A discharge check valve 18 is provided in the outlet pipe portion 16 for discharging the water to the boiler 2 by opening a fluid passage of the discharge pipe portion 16 when pressure in the fluid vessel is increased. An inlet check valve 19 is provided in the inlet pipe portion 17 for sucking the water from the water condensing device 8 into the fluid vessel 11 by opening a fluid passage of the inlet pipe portion 17 when the pressure in the fluid vessel 11 is decreased.

An operation of the above described water pump 10 will be explained with reference to FIGS. 2A to 2D.

As shown in FIG. 2A, when the heating device 12 and the cooling device 13 are operated in the water pump 10, the working fluid (water) in the straight pipe portion 11*b* adjacent to the inert gas and the heating device 12 is heated and vaporized by the heating device 12 (an isothermal expansion), the vaporized steam is further expanded (an adiabatic expansion), and thereby a liquid surface in the straight pipe portion 11*b* is pushed down, as shown in FIG. 2B. Accordingly, the liquid working fluid flows in the fluid vessel 11 from the straight pipe portion 11*b* to the other straight pipe portion 11*c*, to open the discharge check valve 18 and discharge the working fluid from the fluid vessel 11 toward the boiler 2.

When the liquid surface of the working fluid in the straight pipe portion 11*b* comes down to the cooling device 13, the vaporized steam is cooled down and liquidized by the cooling device 13, as shown in FIG. 2C, and the pressure for pushing down the liquid surface disappears (an isothermal compression to adiabatic compression), and finally the liquid surface in the straight pipe portion 11*b* goes up, as shown in FIG. 2D. In this operation, negative pressure is generated in the working fluid in the other straight pipe portion 11*c* on a side of the inlet check valve 19, to open the inlet check valve 19 and to suck the working fluid from the water condensing device 8 into the fluid vessel 11.

Thus, the expansion and contraction of the working fluid in the fluid vessel 11 causes a fluid flow of back and forth directions in the bending pipe portion 11*a*, and such expansion and contraction are periodically performed. Accordingly, the liquid pump (water pump) 10 of the embodiment can automatically suck the working fluid from the water condensing device 8 of the Rankine cycle apparatus, wherein the working fluid is liquidized, and the liquid pump 10 automatically supplies the working fluid to the boiler 2.

As explained above, according to the Rankine cycle apparatus of the embodiment of the present invention, the water pump 10 of the present invention is used as the fluid pump for circulating the working fluid (water), instead of the conventionally used electrical pump.

And according to the above water pump 10, the working fluid is automatically sucked from the water condensing device 8 and supplied to the boiler 2 by simply heating and cooling the working fluid in the fluid vessel 11. As a result, it is not necessary to supply the electric power from the outside of the water pump, and thereby the Rankine cycle apparatus becomes simpler in structure and lower in cost.

It is necessary to heat and cool the working fluid in the fluid vessel 11 in order to operate the water pump 10 of the present invention. However, the heat for super-heating the working fluid at the super-heating device 4 is partly dumped away as the waste heat in the Rankine cycle apparatus. And therefore, when the waste heat is used to operate the water pump 10, a running cost for operating the water pump 10 can be remarkably reduced.

Second Embodiment

A second embodiment of the present invention will be explained with reference to FIG. 3, which schematically shows a Rankine cycle apparatus according to the second embodiment.

As shown in FIG. 3, the Rankine cycle apparatus comprises the boiler 2, the super-heating device 4, the turbine 6, the water condensing device 8 and a water pump 20, wherein the second embodiment differs from the first embodiment in the structure of the water pump 20. And therefore, the water pump 20 will be mainly explained in the following description.

The water pump 20 comprises a circular pipe portion 21 (a circular fluid vessel 21) and the heating device 12 and the cooling device 13 are provided at one of the vertically extending straight pipe portions, in such a manner that the cooling device 13 is arranged at a position vertically higher than the heating device 12.

As in the same manner to the first embodiment, the fluid vessel 21 is made of such material having a high heat insulating performance for those portions other than those for the heating device 12 and the cooling device 13, while those portions for the heating device 12 and the cooling device 13 are made of such material having higher thermal conductivity, as cupper or aluminum.

The water pump 20 further has, like the first embodiment, the horizontally extending pipe portion 15 extending from an upper end of the circular pipe portion 21, and the other end of the horizontal pipe portion 15 is connected to the outlet (discharge) pipe portion 16 for discharging the working fluid from the fluid vessel 11 to the boiler 2, and further connected to the inlet pipe portion 17 for sucking the working fluid from the water condensing device 8.

A control valve 24 is provided at a lower portion of the circular pipe portion 21 (at a position lower than the heating device 12) for opening and closing the fluid passage, and the control valve 24 is controlled by a driver circuit 30 so that the fluid passage is periodically opened and closed.

In the above described water pump 20, the movement of the fluid flow in the fluid vessel 21 is stopped during the control valve 24 is closed. The working fluid in the fluid vessel 21 can be sufficiently heated by the heating device 12, so that the water is vaporized and the vaporized steam can be expanded in the fluid vessel 21. Then, the discharge check valve 18 is opened due to the expansion pressure and the working fluid is discharged from the water pump 20 to the boiler 2.

The vaporized steam rises in the vertically extending straight pipe portion of the fluid vessel 21 from the heating device 12 to the cooling device 13. The driver circuit 30, however, controls to periodically open the control valve 24 in a synchronized manner to the rising movement of the vaporized steam after closing the control valve 24. Accordingly, the steam generated and expanded by the heating device 12 smoothly flows from the heating device 12 to the cooling device 13. The steam is cooled down and liquidized by the cooling device 13. In this operation, negative pressure is generated in the working fluid in the fluid vessel 21 on the side of the inlet check valve 19, to open the inlet check valve 19 and to suck the working fluid from the water condensing device 8 into the fluid vessel 21.

As above, as in the same manner to the water pump 10 of the first embodiment, the liquid pump (water pump) 20 of the second embodiment periodically moves the working fluid in the fluid vessel 21 and automatically sucks the working fluid from the water condensing device 8 of the Rankine cycle apparatus, wherein the working fluid is liquidized, and the liquid pump 20 automatically supplies the working fluid to the boiler 2.

According to the above second embodiment, it is necessary to provide the driver circuit 30 for controlling the operation of the control valve 24. The driver circuit 30, however, simply controls the control valve 24 to periodically open and close the same. Therefore, the driver circuit 30 can be made with a much simpler structure than a driver circuit for operating the electrical pump, and thereby the Rankine cycle apparatus according to the present invention becomes simpler in structure and lower in cost. Furthermore, since the waste heat from the Rankine cycle apparatus can be used for heating the working fluid in the fluid vessel 21, a running cost for operating the water pump 20 can be remarkably reduced.

Third Embodiment

Figure 4:
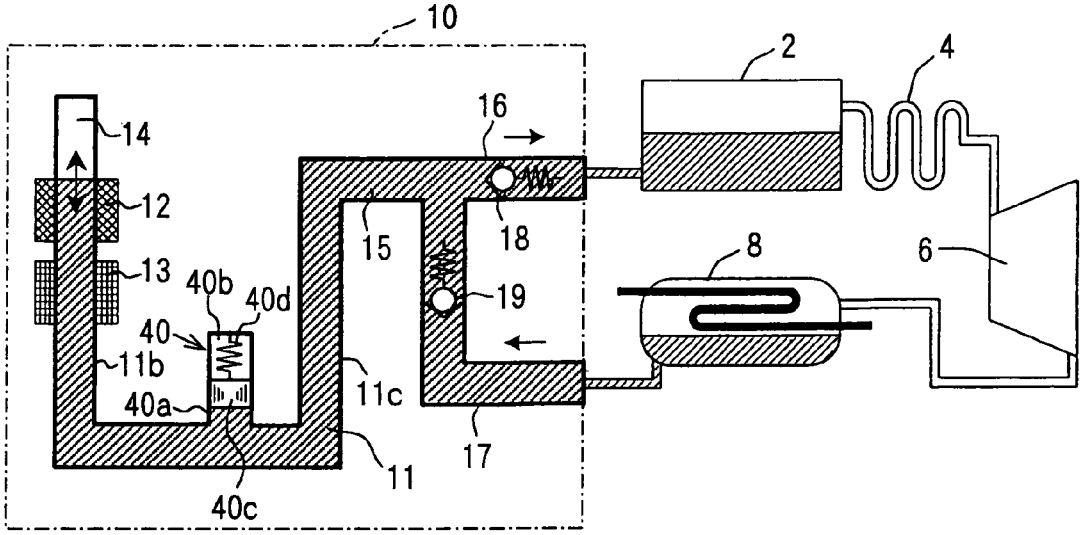
FIG. 4 is a schematic view showing a Rankine cycle apparatus according to a third embodiment of the present invention.

A third embodiment of the present invention will be explained with reference to FIG. 4, which differs from the first embodiment in that a buffering device 40 is further provided in the Rankine cycle apparatus.

A reference numeral 40 is the buffering device provided to the bending pipe portion 11*a* of the fluid vessel 11. The buffering device 40 can be provided to the fluid vessel 11 at any point between the heating device 12 and the discharge and inlet check valves 18, 19. The buffering device 40 comprises a further pipe portion 40*a* vertically extending from the bending pipe portion 11*a*, an upper end of which is closed to form a buffering chamber 40*b*. A piston 40*c* is reciprocally arranged in the buffering chamber 40*b*, and a coil spring 40*d* is also arranged in the buffering chamber 40*b* to downwardly urge the piston 40*c*. An inert gas is filled into the closed buffering chamber 40*b*.

According to the above third embodiment, the piston 40*c* is moved upwardly, when the working fluid is heated and vaporized by the heating device 12 and thereby the fluid pressure in the fluid vessel 11 is increased, so that the inert gas in the buffering chamber 40*b* and the coil spring 40*d* are compressed. As a result, a rapid increase of the fluid pressure in the fluid vessel 11 can be absorbed.

Fourth Embodiment

Figure 5:
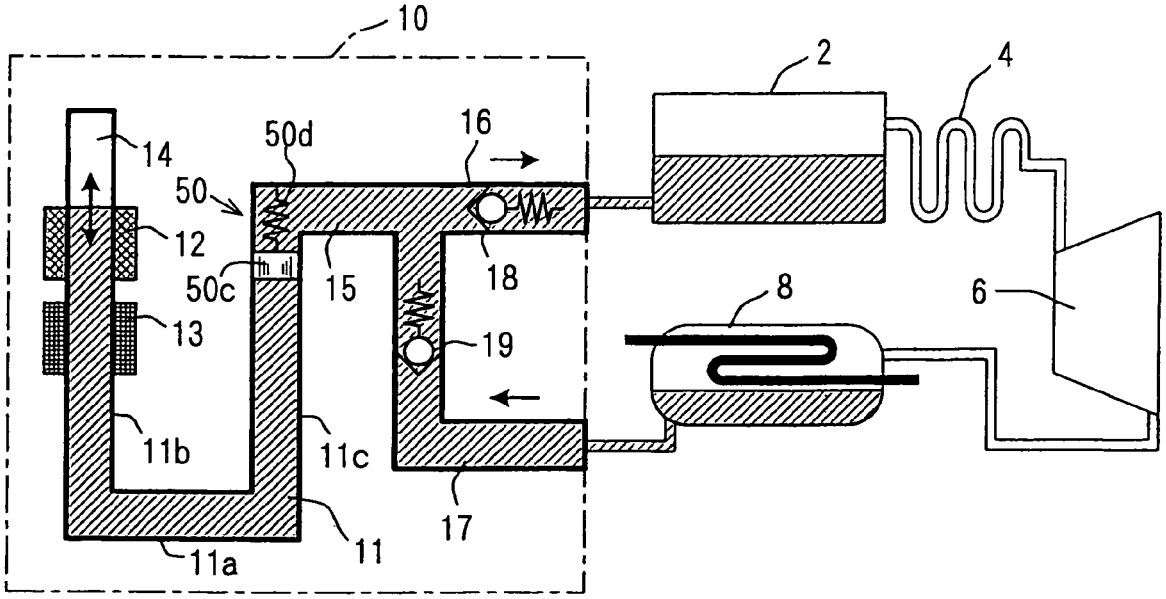
FIG. 5 is a schematic view showing a Rankine cycle apparatus according to a fourth embodiment of the present invention.

A fourth embodiment of the present invention will be explained with reference to FIG. 5, which differs from the first embodiment in that a buffering device 50 is further provided in the Rankine cycle apparatus.

A reference numeral 50 is the buffering device provided to the straight pipe portion 11*c* of the fluid vessel 11. The buffering device 50 can be provided to the fluid vessel 11 at any point between the heating device 12 and the discharge and inlet check valves 18, 19. The buffering device 50 comprises a piston 50*c* reciprocally arranged in the straight pipe portion 11*c*, and a coil spring 50*d* also arranged in the straight pipe portion 11*c* for urging the piston 50*c* toward the heating device 12.

Even with such arrangement, the rapid increase of the fluid pressure of the working fluid in the fluid vessel 11 can be likewise avoided.

Although not shown and not explained in the above third and fourth embodiments, stopper means are provided in the fluid vessel 11 (or in the pipe portion 40*a*) for limiting the reciprocal movement of the piston 40*a* (or 50*a*).

Other Embodiments

In the above second embodiment, the control valve 24 is provided in the circular fluid vessel 21 to stop the flow of the working fluid at heating the working fluid by the heating device 12. The control valve is therefore provided for the purpose of effectively performing the heating and cooling the working fluid. It is, however, also possible to periodically heat and cool the working fluid without providing the control valve 24.

What is claimed is:

1. A liquid pump comprising:

a fluid vessel in which working fluid is filled and the working fluid can move;

a heating device for heating the working fluid in the fluid vessel and vaporizing the working fluid;

a cooling device for cooling down and liquidizing the steam vaporized by the heating device;

a discharge check valve provided at an outlet passage of the pump, and opening the outlet passage by fluid flow caused by expansion pressure of the steam to thereby discharge the working fluid to an outside; and an inlet check valve provided at an inlet passage of the pump, and opening the inlet passage by fluid flow caused by liquidation of the working fluid to thereby suck the working fluid from the outside;

wherein the fluid vessel comprises:

a U-shaped pipe portion having a bending pipe portion and pair of vertically extending straight portions extending from the bending pipe portion, wherein the bending pipe portion is arranged at a lower most position of the U-shaped pipe portion;

wherein the heating device and the cooling device are provided at one of the straight pipe portion, and wherein the discharge check valve and the inlet check valve are respectively provided in fluid passages connected to the other straight pipe portion.

2. A liquid pump according to claim 1, wherein the heating device is arranged at a position vertically higher than the cooling device.

3. A liquid pump according to claim 1, further comprising:

means for periodically applying fluid vibration to the working fluid in response to the heating and cooling thereof.

4. A liquid pump according to claim 3, wherein the means for periodically applying fluid vibrations is a gas filled in the fluid vessel for applying the fluid vibration by its compressive reacting force.

5. A liquid pump comprising:

a fluid vessel in which working fluid is filled and the working fluid can move;

a heating device for heating the working fluid in the fluid vessel and vaporizing the working fluid;

a cooling device for cooling down and liquidizing the steam vaporized by the heating device;

a discharge check valve provided at an outlet passage of the pump, and opening the outlet passage by fluid flow caused by expansion pressure of the steam to thereby discharge the working fluid to an outside;

an inlet check valve provided at an inlet passage of the pump, and opening the inlet passage by fluid flow caused by liquidation of the working fluid to thereby suck the working fluid from the outside; and a buffering device provided in the fluid vessel for absorbing a rapid increase of fluid pressure of the working fluid in the fluid vessel, when the working fluid is heated and vaporized by the heating device.

6. A liquid pump according to claim 1, further comprising:

a buffering device provided in the fluid vessel for absorbing a rapid increase of fluid pressure of the working fluid in the fluid vessel, when the working fluid is heated and vaporized by the heating device, wherein the buffering device comprises a pipe portion vertically extending from the bending pipe portion.

7. A liquid pump according to claim 1, further comprising:

a buffering device provided in one of the vertically extending straight portion of the fluid vessel and between the heating device and the discharge and inlet check valves for absorbing a rapid increase of fluid pressure of the working fluid in the fluid vessel, when the working fluid is heated and vaporized by the heating device, wherein the buffering device comprises a pipe portion vertically extending from the bending pipe portion.

8. A liquid pump comprising:

a circular fluid vessel in which working fluid is filled and the working fluid can move;

a heating device for heating the working fluid in the fluid vessel and vaporizing the working fluid;

a cooling device provided at a vertically higher position than the heating device and for cooling down and liquidizing the steam vaporized by the heating device;

a discharge check valve provided at an outlet passage of the pump, and opening the outlet passage by fluid flow caused by expansion pressure of the steam to thereby discharge the working fluid to an outside; and an inlet check valve provided at an inlet passage of the pump, and opening the inlet passage by fluid flow caused by liquidation of the working fluid to thereby suck the working fluid from the outside.

9. A liquid pump according to claim 8, further comprising:

a fluid flow control valve for periodically changing a speed of the working fluid moving in the fluid vessel.

10. A Rankine cycle apparatus comprising:

a super-heating device for producing a high pressure steam by super-heating working fluid;

a power generating device for generating kinetic energy by using the high pressure steam of the working fluid;

a condensing device for collecting the steam from the power generating device and liquidizing the working fluid, wherein the Rankine cycle is formed by the super-heating device, the power generating device and the condensing device, and the working fluid is circulated in the Rankine cycle, wherein the Rankine cycle apparatus further comprises;

a liquid pump comprising:

a fluid vessel in which working fluid is filled and the working fluid can move;

a heating device for heating the working fluid in the fluid vessel and vaporizing the working fluid;

a cooling device for cooling down and liquidizing the steam vaporized by the heating device;

a discharge check valve provided at an outlet passage of the pump, and opening the outlet passage by fluid flow caused by expansion pressure of the steam to thereby discharge the working fluid to an outside; and an inlet check valve provided at an inlet passage of the pump, and opening the inlet passage by fluid flow caused by liquidation of the working fluid to thereby suck the working fluid from the outside.

11. A liquid pump according to claim 5, wherein the heating device is arranged at a position vertically higher than the cooling device.

12. A liquid pump according to claim 5, further comprising:

means for periodically applying fluid vibration to the working fluid in response to the heating and cooling thereof.

13. A liquid pump according to claim 12, wherein the means for periodically applying fluid vibrations is a gas filled in the fluid vessel for applying the fluid vibration by its compressive reacting force.

* * * * *